United States Patent [19]

Deiana

[11] Patent Number: 4,487,151

[45] Date of Patent: Dec. 11, 1984

[54] FLOATING HIGHWAY

[76] Inventor: Salvatore Deiana, 202-1390 Nanaimo St., Vancouver, B.C., Canada, V5L 4T6

[21] Appl. No.: 378,174

[22] Filed: May 14, 1982

[51] Int. Cl.[3] ..... B63B 35/34; E01D 15/14

[52] U.S. Cl. ..... 114/266; 114/267; 114/249; 441/21; 441/28; 441/30; 405/63; 405/26; 14/2.6; 14/27

[58] Field of Search ..... 114/266, 257, 77 T, 114/256, 264, 267, 249, 77 R, 352, 353; 405/21, 26, 63, 68, 69; 14/2.4, 2.6, 27, 73, 6, 12; 404/40, 34; 441/39, 28, 29, 22

[56] References Cited

U.S. PATENT DOCUMENTS

| | | | |
|---|---|---|---|
| 2,119,854 | 6/1938 | Day | 441/28 |
| 3,145,681 | 8/1964 | Nakagawa | 114/77 R |
| 3,237,414 | 3/1966 | Straub et al. | 114/74 T |
| 3,276,209 | 10/1966 | Mosdell | 114/266 |
| 3,435,793 | 4/1969 | Shurtleff | 114/257 |
| 3,522,618 | 8/1970 | Stranzinger | 114/266 |
| 3,708,982 | 1/1973 | Blockwick | 114/267 |
| 3,798,911 | 3/1974 | Oberg | 405/69 |
| 3,805,721 | 4/1974 | Robishaw | 114/266 |
| 4,048,802 | 9/1977 | Bowley | 405/26 |
| 4,174,185 | 11/1979 | Toki | 405/63 |

FOREIGN PATENT DOCUMENTS

| | | | |
|---|---|---|---|
| 212084 | 12/1957 | Australia | 114/266 |
| 1580477 | 7/1969 | France | 405/63 |
| 55-083 | 4/1980 | Japan | 114/266 |

OTHER PUBLICATIONS

Civil Engineering Magazine, "Building the World's Largest Floating Bridge" Jan., 1940.

*Primary Examiner*—Trygve M. Blix
*Assistant Examiner*—Patrick W. Young
*Attorney, Agent, or Firm*—Antonelli, Terry & Wands

[57] ABSTRACT

The present invention is a floating highway unit which has a structure which facilitates both removal from linkage in a series of units forming the highway, provides for simple alignment of the units during assembly, and also allows vertical movement caused by tides and waves. Protection is provided for the highway by use of a partly floating barrier, for damping wave motion, thus substantially reducing the amount of absolute and relative movement of the floating highway units. Each of the floating units of the present invention is comprised of a generally rectangular horizontal pontoon including provisions for floatation of the pontoon, the pontoon having a centrally located horizontal tongue extending outwardly from a short side of the pontoon whereby the top surface of the tongue is an extension of the top surface of the pontoon. A recess is located in the opposite side of the pontoon having a shape for enclosing the tongue which matches the shape of the tongue. A slot extends across the width of the tongue, and a pair of in-line slots extends across at least part of each of the opposite sides of the pontoon into the recess on opposite sides of the recess respectively. The later slots are coextensive with the slot in a tongue of an adjacent pontoon when it is enclosed in the recess. A key is inserted in the coextensive slots to retain the floating units together.

13 Claims, 13 Drawing Figures

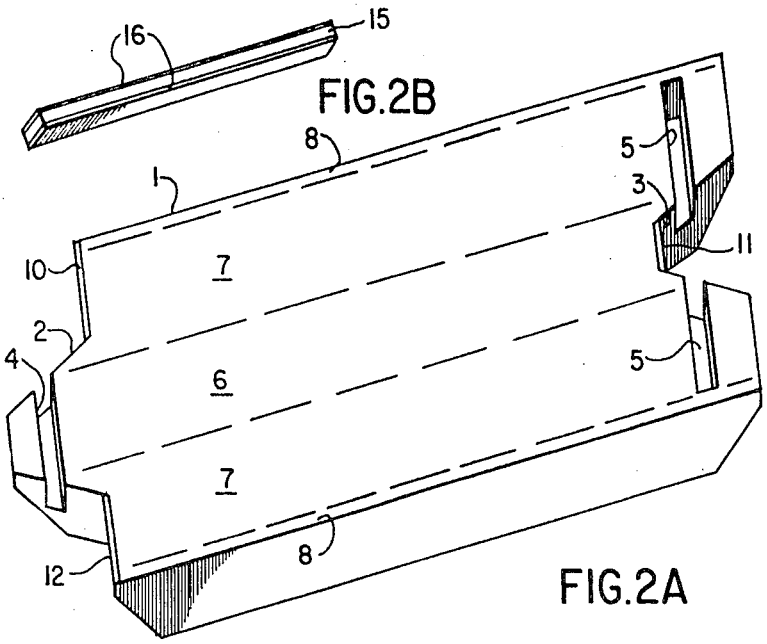
FIG.2B
FIG.2A
FIG.2C
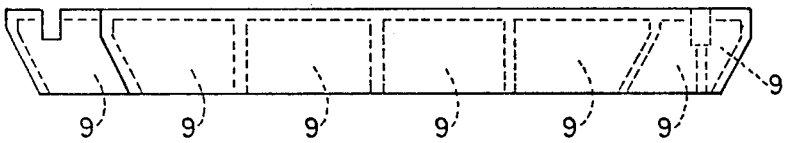
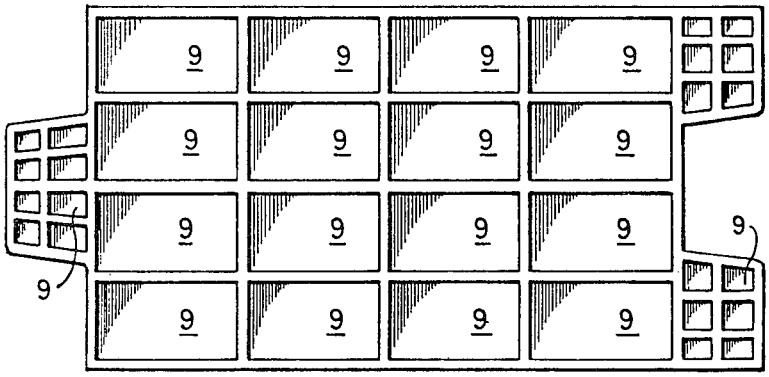
FIG. 2D

FLOATING HIGHWAY

This invention relates to floating structures, and more particularly to a floating highway.

The cost of construction and maintenance of bridges, and highways and railways in mountainous terrain is usually very high. In some locations the construction of major sections of such highways or bridges can be eliminated by the construction of a floating highway. This form of highway is advantageously used in fjord regions, along other coastal regions to link an island to the mainland, etc.

A floating highway is not entirely new; for instance in U.S. Pat. No. 3,659,450 a floating walkway or causeway is described. This structure contemplates incorporating service ducts running from section to section. "Finger floats" are required for stability; individual sections of the units are linked together in a manner which butts the ends of the units. Should an individual unit be required to be removed for repair or other reason, it must be unlinked, and the abutting units must be moved outwardly therefrom in order to allow room for the unit under repair to be shifted outwardly sideways.

This structure is not suitable for use as a floating highway, since to facilitate removal of an individual unit, the remainder of the highway could not be shifted away from the unit due its great length and mass. Further relative sideways movement is possible due to the manner of linkage, after normal wear and tear of use.

The present invention is a floating highway unit which has a structure which facilitates both removal from linkage in a series of units forming the highway, provides means for simple alignment of the units during assembly, and also allows vertical movement caused by tides, waves, etc. The linkage structure in the present invention also is of a stronger form than the prior art, which is required for floating highway structures, rather than walkways, particularly for use in the sea.

In addition, means is provided for protecting the highway by means of a partly floating barrier, for damping wave motion, thus substantially reducing the amount of absolute and relative movement of the floating highway units. This allows the highway to be used not only for automobiles, but also for railways, the latter of which would clearly not be feasible with floating units having wide gaps between floating units or exhibiting relative rolling motion.

Each of the floating units of the present invention is comprised of a generally rectangular horizontal pontoon including means for floatation of the pontoon, the pontoon having a centrally located horizontal tongue extending outwardly from a short side of the pontoon whereby the top surface of the tongue is an extension of the top surface of the pontoon. A recess is located in the opposite side of the pontoon having a shape for enclosing the tongue which matches the shape of the tongue. A slot extends across the width of the tongue, and a pair of in-line slots extends across at least part of each of the opposite sides of the pontoon into the recess on opposite sides of the recess respectively. The latter slots are coextensive with the slot in a tongue of an adjacent pontoon when it is enclosed in the recess.

A key comprised of rigid material having length substantially greater than the width of the tongue has a pair of strips of elastomer material fixed to opposite sides thereof each having a width which is about the same as the height of the key, the material being faced with steel plates. The combined thickness of the strips of elastomer material, steel plates and the rigid material is approximately the thickness of the slots, but not greater. The height of the key is no greater than the depth of the slots. When a tongue is enclosed by a recess, the key is inserted into all three of the now coextensive slots, thus retaining the tongue in the recess. Once inserted in the slots, the top edge of the key is preferably at the level of the surface of the pontoon, although in some designs it may be below the surface of the pontoon. If the top edge of the key is below the level of the pontoon, a steel plate may be placed across the top of the slot at the surface of the floating unit to facilitate the running of automobiles thereacross.

A better understanding of the invention will be obtained by a consideration of the detailed description below, in conjunction with the following drawings, in which:

FIG. 2A is a perspective of one section of the floating highway,

Figure 3:
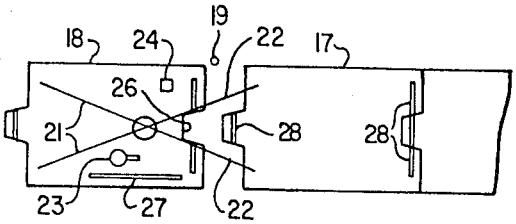
Figure 4:
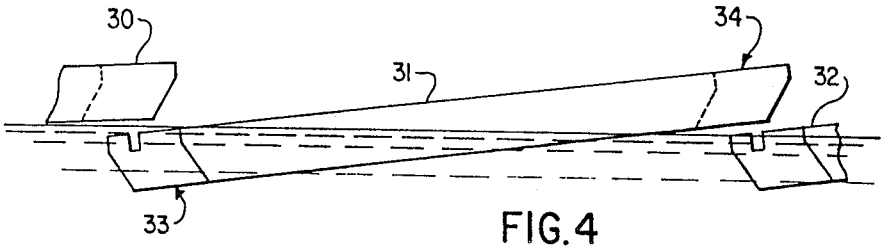
Figure 5:
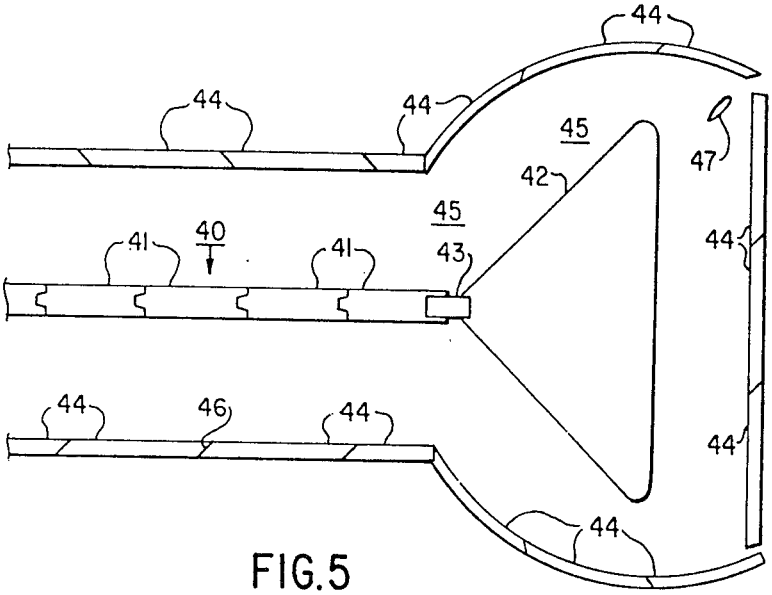
Figure 6:
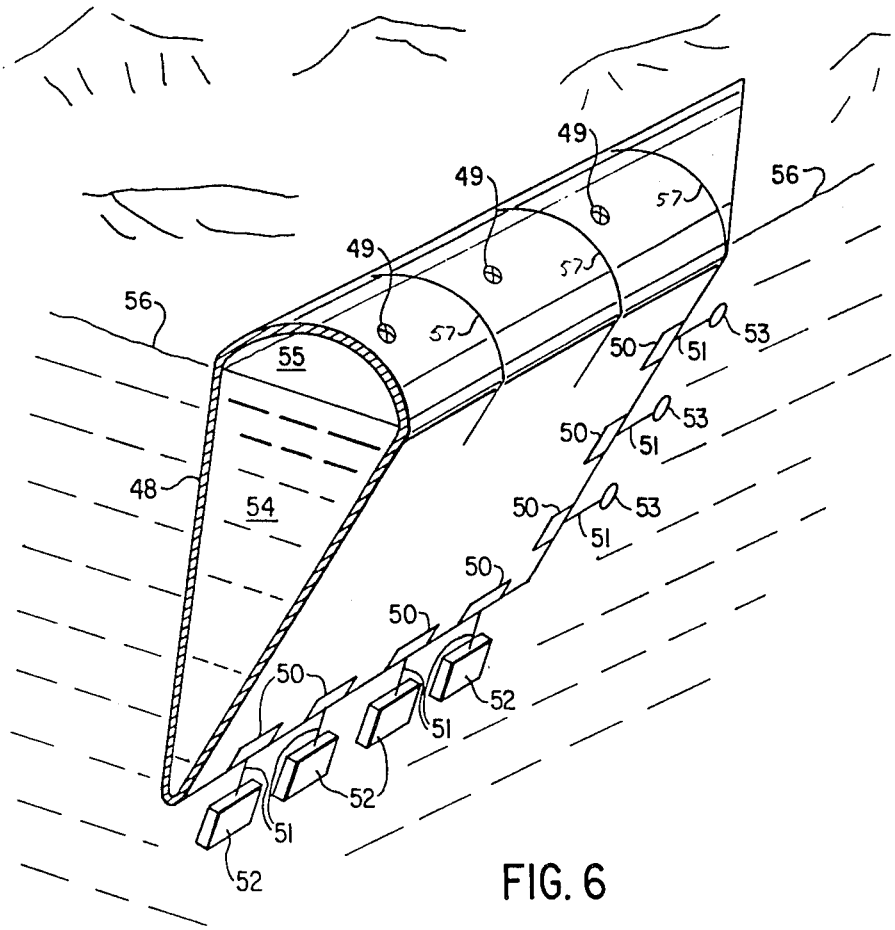

FIG. 2B is a perspective of a key structure for joining the sections of the highway together, FIG. 2C is a section through the central axis of one section of the highway, FIG. 2D is an underside view of one section of the highway, FIG. 3 is a plan view of a portion of the highway to illustrate how sections of the floating highway are assembled, FIG. 4 is a schematic side elevation of a portion of the highway showing how sections of the floating highway can be disassembled, FIG. 5 is a plan view of the floating highway in conjunction with an artificial breakwater for producing an artificial basin, FIG. 6 is a cross-section of the preferred form of artificial breakwater.

Figure 6A:
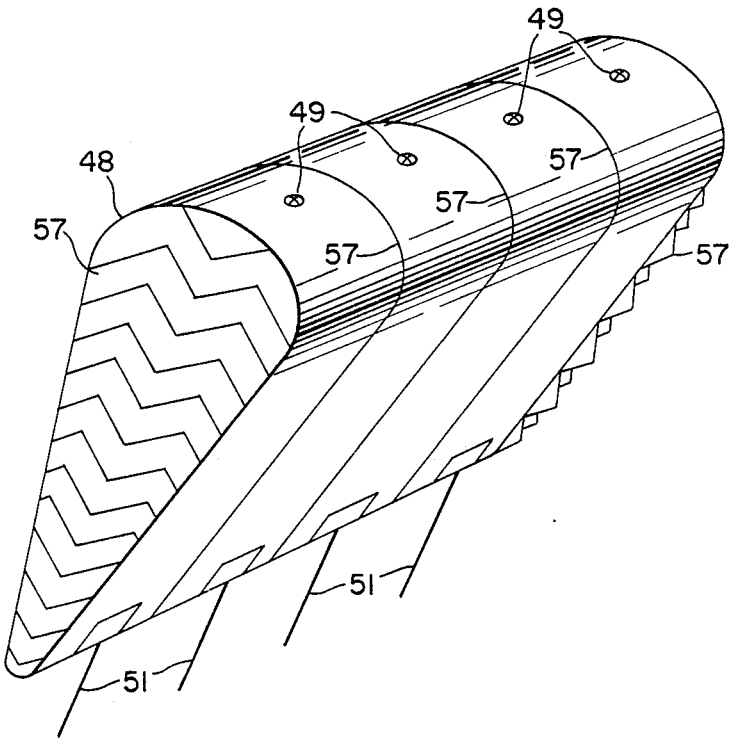

FIG. 6A is a perspective view of an artificial breakwater section similar to that shown in FIG. 6, FIGS. 7A, 7B and 7C are end views of the artificial breakwater section shown in various kinds of sea conditions.

Figure 1:
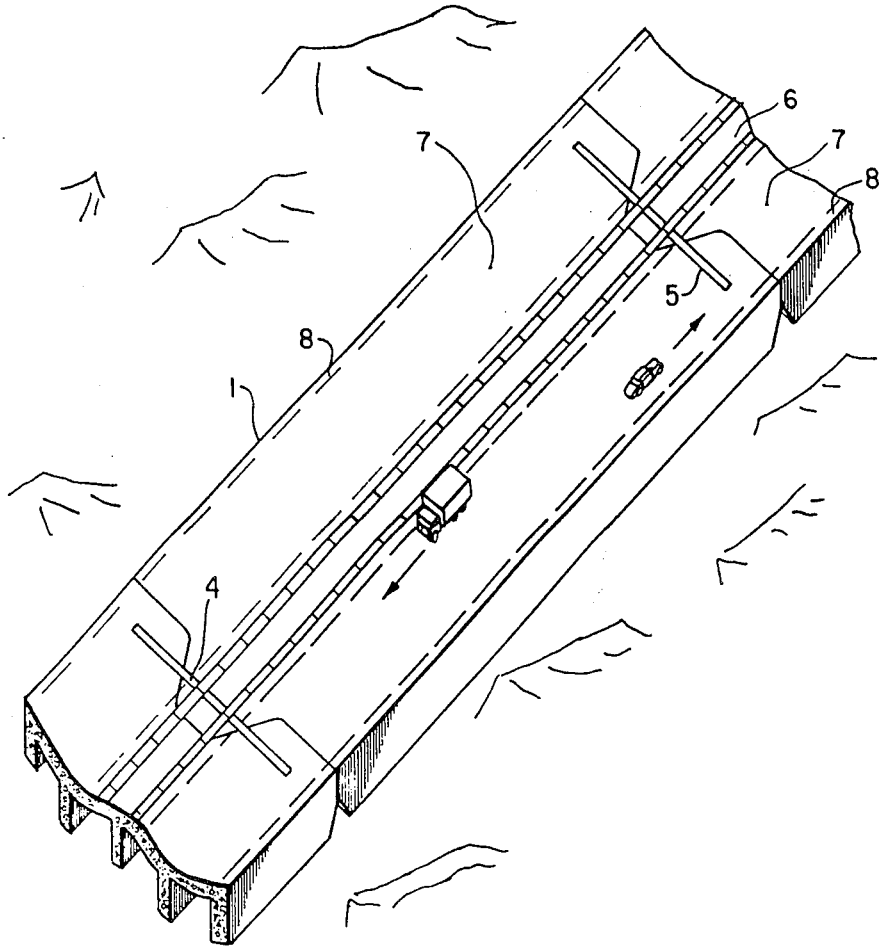
FIG. 1 is a perspective of the floating highway in use.

Turning now to FIG. 1, a portion of the preferred form of the floating highway is shown in position. The details of the highway will be better understood by further reference to FIG. 2A, which shows one of the sections of the highway.

The highway is comprised of a plurality of floating pontoons 1, each having a tongue 2 extending forward of a short side thereof, and a cooperating recess 3 having a shape for enclosing the tongue, extending inwardly of the opposite end of the pontoon. A slot 4 extends across the width of the tongue, coextensive with a pair of in-line slots which extend across at least part of both opposite sides of the pontoon into the recess. A concrete pontoon faced with elastomer material to facilitate some flexibility is located within each of the coextensive sets of slots, functioning so as to key the pontoons together.

The pontoons are made of thin wall concrete, which entrap air therebelow for floatation. Slots 4 and 5 (to be described in more detail below) are pavement recessions that do not communicate with supporting air pockets 9 of the pontoon, thus ensuring total air entrapment therebelow.

In a typical installation, the width of each pontoon is allocated into sections, a central section 6 of typically 25 feet in width to accommodate rail traffic, a 22 foot roadway right-of-way 7 on each side of the rail right-of-way for accommodating automobiles, and a 5½ foot right-of-way 8 along each edge, typically one to accommodate bicycles, and the other to accommodate pedestrians and services such as gas and electricity supplies.

The width of each pontoon preferably is about 80 feet, the length is about 176 feet, and the extension of the tongue is about 15 feet. The length of the key is about 76½ feet, accommodated by a corresponding keyway slot, leaving a guard of about 2 feet between each slot end and the side of the pontoon. The height of the pontoon is about 12 feet.

The highway can be used in the open sea along coastal areas, across lakes, joining islands with each other or the mainland, etc. The flexibility afforded by the elastomer pads on each side of the key provides sufficient flexibility to allow the highway to rise and fall with tides, yet be sufficiently rigid relative to each other to accommodate the passage of rail and road traffic over successive pontoons safely.

In relative calm water areas, the floating highway can be used as shown in FIG. 1. However where rough seas are expected to be encountered, an artificial breakwater, or a reef, for protecting the floating highway should be used, as is shown in FIG. 5, and will be described in more detail below.

In FIGS. 2A–2D, details of each of the pontoons which are linked to form the highway is shown. Each pontoon is precast of concrete. The underside of the pontoon is thus of egg crate construction 16 air pockets 9 being formed under the pontoon, thus for buoying the pontoon when in place in a body of water.

It is also preferred that the top surface of the tongue (and the cooperating recess) should be in the form of a truncated triangle, with the lower part of the sides below the tongue, recess, and front and rear of the pontoon sloping inwardly, and the top corners rounded. Elastomeric strip 10, 11 and 12 are glued along the front top edge of the pontoon on each side of the tongue, and within the recess along its most inward edge.

It should be noted that the elastomeric material provides a resilient bumper as between adjacent edges of adjacent pontoons.

It is also preferred that the underside of the tongue and sides alongside the recess should be sectioned into an egg crate construction, with smaller cavity crossections, in order to provide stress-absorbing beams, since maximum stress on each pontoon is encountered in the tongue and in the shoulders alongside the cavity.

FIG. 2B is a perspective view of a key to be inserted in all three coextending slots extending from one side, within a tongue of an adjacent pontoon, and across the other side of a pontoon. The key is fabricated of a prestressed concrete core 15, faced on each side with two elastomeric pads 16 glued to each surface. The key preferably is 76 feet long by 5 feet high and 1 foot thick. The elastomeric pads are each 3½ inches thick.

FIG. 3 will be used to explain the method of assembly of adjacent pontoons. Each pontoon, fabricated on shore, is pulled along rollers by a tow boat into a body of water, from which it is towed to the position of the highway to be assembled. Let us assume that pontoon 17 is already linked to the remainder of the highway, and pontoon 18 is to be further linked thereto. Pontoon 18 will have been manoeuvered into the position shown by a tug, and anchored into a stable position by means of anchor 19. A crane 20 is anchored by means of cables 21 to rearward portions of the pontoon, and by further cables 22 to pontoon 17. Crane 23 then extends to lift anchor 19, and places it on the surface of pontoon 18, e.g. at position 24.

Crane 23, pulling alternately or simultaneously on cables 22, which are counterbalanced by cables 21, gradually pulls pontoon 18 toward pontoon 17, aligning its tongue 25 into cavity 26. Once pontoon 18 is in position, and is held there by crane 20, crane 23 lifts key 27, which had been stored on the surface of pontoon 18, and drops it into the coextensive slots 28 which extend across both pontoon 17 and the tongue of pontoon 18. The two slabs 17 and 18 are thus locked together. Crane 23 can now lift the anchor from position 24 and drop it behind the pontoon 18, thereby stabilizing it until a further pontoon is moved into position.

With the structure sizes described, 30 pontoons cover a mile of highway. The maximum carrying load for the preferred embodiment is 3 million pounds. For additional joint rigidity, the anchoring key thickness should increase at the expense of the elastomeric pads on opposite sides of the key, thus limiting articulation. This increases the stability in heavy seas, but increases the stress along the slots in the pontoons. For this reason, in open sea an artificial breakwater should be used, as will be described later.

It is preferred that each egg crate cavity should have an air valve connected thereto, whereby the air pressure within each cavity can be controlled. The structure of such valves is well known and need not be shown. However for repair of the pontoon, it may be necessary to release the air pressure within one or more cavities. In case of damage to the pontoon, it is preferred that styrofoam chips should be pumped into the air chambers to maintain the pontoon afloat. After the pontoon damage is repaired, the styrofoam chips can be removed if desired, and replaced by air.

It is preferred that the maximum ratio of water to cement for increased water absorbtion should be 040, and polymer must be added to the cement mix. Prestressing or poststressing should also be used to limit shrinkage of the concrete as the pontoons age. After several years, the thickness of the elastomeric pads should be increased to correct gaps.

Each rail track set should preferably have 1¾ inches of gap between pontoons at the stress free point so as to allow the gap to close and to expand, and each rail should preferably be cut at the edges of the pontoon at a 50° angle to ensure continuity in the expanded position. However if increased rigidity is desired, the gap can be reduced accordingly.

A major advantage of the present structure is that it provides means for replacement of the pontoons in case of major damage. A description thereof will be made with reference to FIG. 4.

FIG. 4 shows three adjacent pontoons 30, 31 and 32, tilted to allow replacement of pontoon 31. Air is removed from the chambers, thus causing tilt. Clearly the slot at end 33 will drop below the level of pontoon 30. Similarly, end 34 of pontoon 32 should be tilted below end 34 of pontoon 31.

Further, the end 34 of pontoon 31 will rise, carrying the key out of the slot from adjacent pontoon 32. End 33 must drop below the bottom of pontoon 30 and the bottom at end 34 must rise above the top of pontoon 32. If the amount of air which is removed from end 33 is insufficient to effect the above, air can be removed from the opposite end of pontoon 30 and from the adjacent end of pontoon 32 in order to cause the adjacent end of pontoon 30 to rise and the adjacent end of pontoon 32 to drop.

Once the top of end 33 and the bottom of end 34 of pontoon 31 are clear of the adjacent pontoons, a tug is used to pull pontoon 31 sideways from the axis of the road. Once it has cleared the road, air can be pumped into end 33, thus stabilizing pontoon 31 in a horizontal position, and it can then be towed to a drydock for repair, or it can be scrapped. A replacement pontoon is placed in position with the reverse steps to those noted for removal. Clearly the remainder of the highway need not be moved axially for this operation, which will be a virtually impossible or extremely difficult operation.

In order to avoid drift, during the removal or replacement operation, pontoons 30 and 32 should be anchored to the bottom as described earlier. When a replacement pontoon is placed in position, if required the pontoons can be axially aligned using a technique as described earlier with reference to FIG. 3.

As noted earlier, where rough seas are expected, an artificial breakwater should be used to protect the floating highway from wave action. FIG. 5 is a plan view showing how the barrier is intended to be used, and a cross-section and partial perspective of the barrier is shown in FIG. 6.

A floating highway 40 is shown in FIG. 5, fabricated of sections 41, of the form and linked together, as described earlier. The floating highway is shown linked to a deep sea terminal 42, e.g., of the type having a liquid natural gas facility. A steel ramp 43 links the surface of the deep sea terminal with the floating highway, to accommodate vertical relative movements between the floating highway and the deep sea terminal.

A breakwater system formed of synthetic curtain sections 44, of the type to be described with reference to FIG. 6, are located around the floating highway and/or deep sea terminal, preferably forming an artificial basin 45 between the curtain and terminal. It is preferred that the ends of the curtain sections should form an angle, e.g. 45°, with the sides of the curtain, at both ends. As a result, the ends of the curtains abut obliquely as shown at 46. As a result, wave movement has considerable less tendency to separate the curtain sections, since wave action against the side surface of the curtain from directions of 135° (for a 45° oblique junction) now tends to compress the curtain junctions. The more oblique the angle of the end relative to the side of each curtain, the wider the angle from which wave motion can be received to compress the abutting ends of adjacent curtain sections.

The breakwater considerably reduces the wave action against the floating highway, thus allowing it to remain stable in heavy seas.

In FIG. 5, a portion of the breakwater has been shown as open, to facilitate the passage of ships 47 to the deep sea terminal, and to be anchored in the quiet artificial basin.

FIG. 6 is a cross-section and partial perspective of a synthetic curtain section. The structure is comprised of an elongated container 48 formed of a reinforced inflatable material such as rubber, or more preferably rubber with a fiber strengthener. A plurality of valves 49 extend from the top surface to the interior of the container connecting with compartments separated by dividers 57. The ends of the container are formed at an angle to the sides (one end being shown in FIG. 6), as described earlier.

Reinforced pads 50 are located at spaced intervals along the bottom of the container, as well as along opposite sides of the end edges. Rubber coated steel cables 51 are fixed to the container centrally of each pad, with anchors 52, preferably of concrete material, attached to the cables 51 along the bottom of the container, and linkage rings 53 are attached to the cables 51 along the opposite edges which are to be joined to the adjacent curtain section. Linkage rings 53 of adjacent curtains are fixed to each other by any suitable means, such as by clamp rings or the like, thus attaching adjacent curtains together, along both sides.

When first introduced in place, the curtain is partly inflated. Then the concrete anchors are attached as shown. The curtain thus assumes a vertical working position. Water is then allowed to enter container 48 through side entrance valves, or through valves 49. Pressurized air and water are then alternately introduced into the container, in a way such that the curtain maintains a comfortable working height in the water. This is continued until the water is contained within region 54, and pressurized air is contained in region 55. The interface level preferably is at normal water or sea level.

When the structure is formed and filled as described, it takes the form shown in FIG. 6, having a V-shaped bottom and oval shaped top. The curtain section is then connected by links 53 to the next curtain section.

The structure described above provides significant breakwater utility, using the weight of contained sea water as well as an increased barrier height provided by the pressurized air region to withstand the buffeting of the open sea. The artificial breakwater, utilized on both sides of a floating highway as described earlier, provides, in most cases, a sufficient calm water region as to safeguard the floating highway in open sea regions and also a calm interior basin.

The artificial breakwater can of course also be used to protect ocean oil rigs, marinas, deep sea tanker terminals, etc., or can be deployed to protect an area in which sea rescue can take place in relatively calm seas. The curtain can also be used to form an artificial port, e.g. for sandy coastlines.

A person understanding this invention may now conceive of variations or other embodiments, using the principles described herein. All are considered to be within the sphere and scope of this invention as defined in the claims appended hereto.

SUPPLEMENTARY DISCLOSURE

It is preferred that each breakwater synthetic curtain section should be divided into unitary compartments (e.g. four compartments), which are defined by impermeable dividers 57 (see FIGS. 6 and 6A). Thus each compartment can be filled independently, and in case of damage to one compartment, the remaining compartments will still retain the breakwater afloat.

FIG. 6A shows the exterior of the curtain section of FIG. 6, but with its ends not angled with respect to the remainder of the curtain section, for the case in which this form of structure is used, rather than the angled structural form.

It is preferred that the dividers 57 as well as the end walls should be folded like bellows. This allows vertical or horizontal expansion of the curtain section, for the purposes to be described below.

Figure 7C:
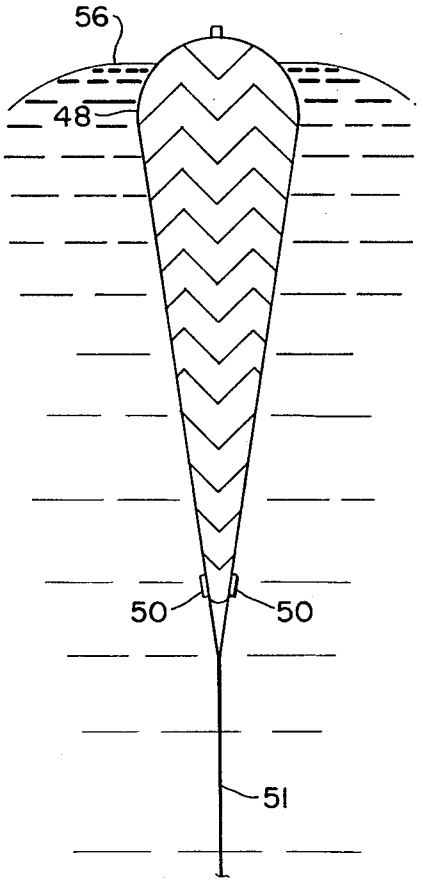
Figure 7B:
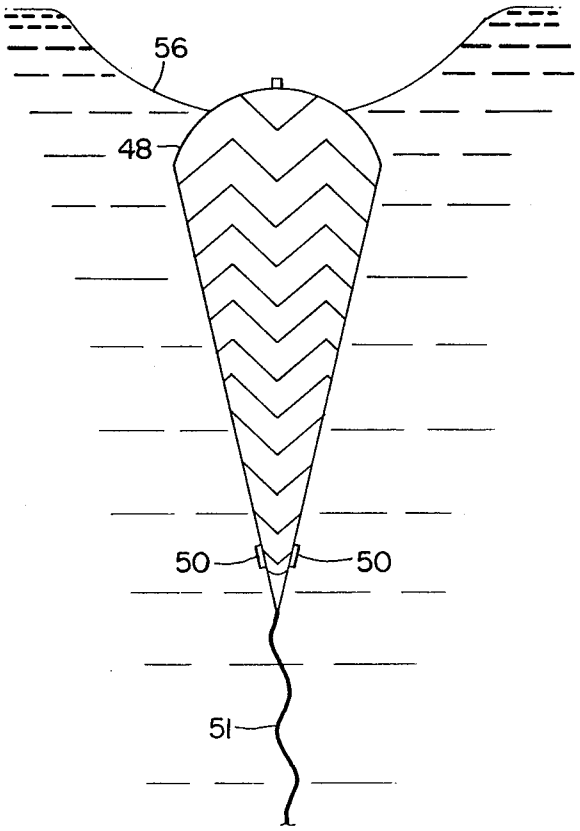
Figure 7A:
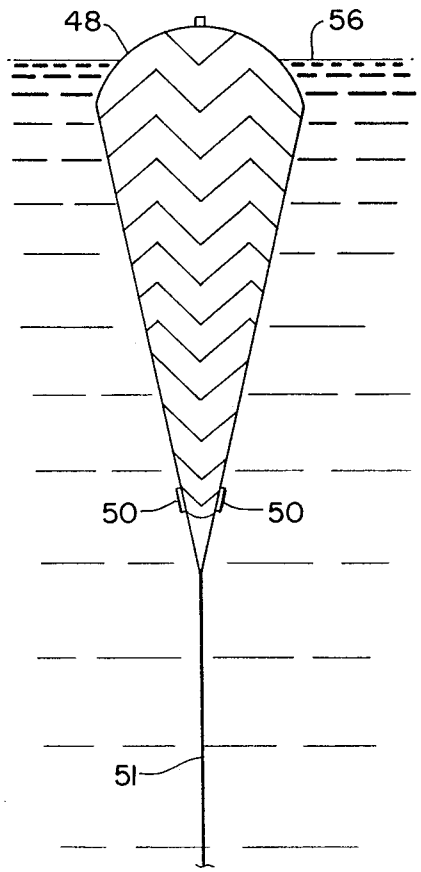

FIGS. 7A, 7B and 7C show an end view of one of the synthetic curtain sections in various sea conditions. In FIG. 7A the sea is calm, and the top of the breakwater floats above the surface due to the air bubble contained therein.

FIGS. 7B and 7C show the breakwater in a stormy sea. In FIG. 7B, the breakwater curtain section, which is not completely filled, is carried between waves, and therefore drops to a lower level than in a calm sea. The top of the breakwater curtain section remains above water due to the contained air bubble. The cable 51 becomes slack.

In FIG. 7C the curtain section is carried upward by a wave. The air bubble maintains the top of the section above the water which would otherwise be prohibited due to the cable length; however the folded shape of the compartment dividers and end portions allow the curtain section to elongate vertically, since the curtain section is not completely filled.

Indeed, it is preferred that the air and water introduced into the compartments should only be made to about 75% of capacity, in order to facilitate the above-described vertical elongation.

While in the embodiment described earlier, cables 51 were indicated as being of rubber coated steel, in the preferred embodiment they should be made of NYLON TM which is considerably lighter than steel. Further, in the preferred embodiment four separate compartments should be used, although it is clear that the invention is not limited thereto.

It should be noted that for a completely secure habour, particularly in open sea, several lines of barrage formed of the breakwater is expected to be required, rather than the single line shown for illustration purposes in FIG. 5.

I claim:

1. A floating highway unit comprised of a generally rectangular horizontal pontoon including means for floatation of the pontoon, a centrally located horizontal tongue which is progressively narrower in plan toward its nose extending outwardly from a short side of the pontoon, the top surface of the tongue being an extension of the top surface of the pontoon, a recess in the opposite side of the pontoon having a shape for enclosing the tongue which matches the shape of the tongue, a slot extending from the to surface of the tongue across the width of the tongue, and a pair of in-line slots from the top surface of the pontoon extending across at least part of said opposite side of the pontoon into said recess on opposite sides of the recess respectively, the latter slots being coextensive with the slot in a tongue of another unit which may be enclosed in the recess.

2. A floating highway unit as defined in claim 1, in which all of said slots have similar width and depth, further including a key comprised of rigid material having length substantially greater than the width of the tongue, a pair of strips of elastomer material fixed to opposite sides of the key, the combined thickness of the strips of elastomer, and the rigid material being approximately the thickness of said slots, and the height of the key being no greater than the depth of the slots, the key being adapted for extension and insertion in all three of coextensive ones of said slots when a tongue of one pontoon is enclosed in said recess of another pontoon, whereby the level of the top edge of said key is at or below the surface of the pontoon.

3. A floating highway unit as defined in claim 2 in which the top edge of said key is approximately in the plane of the surface of the pontoon.

4. A floating highway unit as defined in claim 2 in which the underside of the pontoon is comprised of a plurality of air impermeable cubicles.

5. A floating highway unit as defined in claim 4 in which said cubicles are open at the bottom.

6. A floating highway unit as defined in claim 3 or 4, further including a strip of elastomer material disposed along the front of the pontoon forming a bumper.

7. A floating highway as defined in claim 3, 4 or 5, in which the front surface of the pontoon including the tongue is angled inwardly toward the bottom of the pontoon, a resilient bumper being disposed along the forward front edge of the pontoon on both sides of the tongue, and a further resilient bumper being diposed along the inner upper edge of the recess.

8. A floating highway comprising a plurality of floating concrete pontoons linked together at opposite ends, each pontoon having a tongue at one end which progressively narrows in width toward its nose and which extends forward of the pontoon and a recess in the shape matching that of the tongue at its opposite end, each tongue being enclosed by the recess of an adjacent pontoon, three horizontal slots extending into the slab from the top surface of the slab transversely across the tongue and across the two pontoon regions adjacent the recess, the slots of a tongue and said pontoon regions of a pair of linked pontoons having a common axis, and a key disposed in said common axis slots of each pair of linked pontoons.

9. A floating highway as defined in claim 8 further including a bumper interposed between each pair of linked pontoons.

10. A floating highway as defined in claim 9 in which the key is fabricated of prestressed concrete having an elastomeric pad affixed on opposite sides thereof, the key being disposed in position in said slots with its upper surface in about the same plane as the upper surface of the linked pontoons, and the elastomeric pads oriented vertically on each side thereof.

11. A floating highway as defined in claim 10, in which the front and rear of each pontoon, including the tongue and the recess is inclined inwardly toward the bottom below a substantially vertical rim of predetermined width, an elastomeric strip covering said rim along the front of each slab beside the tongue and along the inner side of the recess.

12. A floating highway as defined in claim 1, further includng an artificial breakwater spaced from the sides of the highway comprised of a plurality of abutting curtain sections spaced along the bottom thereof, means at each end for linking the curtain sections together, and means for introducing and means for retaining a predetermined amount of air within the upper portion of each curtain section over a predetermined amount of water contained therein, the ends of each curtain section being formed at an angle to the sides thereof.

13. A floating highway as defined in claim 12, in which the sides of the curtain sections are impermeable.

* * * * *